US005984799A

United States Patent [19]

Romano

[11] Patent Number: 5,984,799

[45] Date of Patent: Nov. 16, 1999

[54] GOLF CLUB SWING TRAINING DEVICE

[76] Inventor: Edward A. Romano, 3563 Trevis Way, Carmel, Calif. 93923

[21] Appl. No.: 09/150,547

[22] Filed: Sep. 9, 1998

[51] Int. Cl.[6] ..... A63B 69/36

[52] U.S. Cl. ..... 473/234

[58] Field of Search ..... 473/228, 233, 473/234

[56] References Cited

U.S. PATENT DOCUMENTS 3,730,530 5/1973 Oka et al. ..... 473/234

5,174,577 12/1992 Warde et al. ..... 473/234

*Primary Examiner*—George J. Marlo

[57] ABSTRACT

The invention is A Soft, Tiny, Golf club-shaft Attachable Audio and Feel-Feedback Golf Swing Tuner of 1/10 Oz Weight. The golfer swings his club with the Tuner's soft 7 to 7½ inches long, ulta-thin, tensilised polymeric foil, untwisted and elevated lengthwise parallel to the target side of the shaft by twin, resilient plastic end-piers snap-fitted onto the club head end of the shaft, and the foil resonates keeping pace with club-face motion. Golfer both hears that motion around him as specific "Go"/"No Go" humming, buzzing and clubshaft quivering signals that repeat when his swing repeats.

1 Claim, 1 Drawing Sheet

GOLF CLUB SWING TRAINING DEVICE

BACKGROUND

Most 6 and under handicap golfers whether or not the weight of the clubhead is balanced controllably as it swings around them. Occasionally their control wanes and the ball goes astray.

Less skilled players have extreme difficulty acquiring this tenuous "Feel of clubhead balance" without in swing "Go"/"No Go" club motion feedback.

The inventor's golf swing training machine U.S. Pat. No. 5,474,299 offers better swing feedback than standing machines of prior art. However it is not suited for swing practice after errant shots during play.

The Swing-Gyde Tm is a 12 inch club grip extension. The unit must be screw-clamped to the bottom of the grip after being first lined up with the clubface with the unit's arm-tip bearing on the golfer's forearm with the clubshaft cocked at 90 degrees. Once so mounted it does'nt help the golfer learn to balance the club for square-center face hits and it is too cumbersome for on course refresher swing practice.

The inventor's LittleBigShot Tm device lead to the present invention. The LBS clips to the target side of the clubshaft in seconds. Its backswing-top click and subtle downswing airspeed whistling are helpful feedback. Unfortunately its 2 Oz weight affects club balance.

A crude clubshaft-mounting outrigger swing feedback device by Simplicity Tm, composed of 2 thick rubber bands stretched around a rickety plastic bow, disappeared from the market along with its maker.

In use, inertia of the outrigger unit caused it to spin uselessly around the clubshaft even in chipping swings. Air speed hum of its bands was supposed to help a golfer pattern club swing motion correctly. The device failed to do its slated task even when secured to the shaft by tape. Its crude bands would hum indiscriminately however one induced them to start humming on the swinging club.

What golfer's need is a soft, tiny, 1/10 Oz. swing tuner that they can snap-fit onto their club-shaft and use within seconds for both practice and ball striking swings with irons or woods. And whose "Go"/"No Go" specific clubface motion feedback humming, buzzing and clubshaft quivvering signals, repeat when his swing repeats thereby prompting him to relax, feeling and dynamically balancing the clubhead throughout the swing, well enough to hit the golf ball solidly and squarely at the target.

SUMMARY OF THE INVENTION

The object of the invention is to provide golfers with a soft, 1/10 Oz. club-shaft clip-on audio and feel feedback golf swing tuner for irons and woods whose soft, tensilised polymeric foil, once stretched parallel to the golfer's clubshaft between the foil's 2 pier-ends, produces specific clubface motion feedback humming, buzzing and club-shaft quivvering "GO"/"No Go" signals that repeat when the golfer's swing repeats, thereby prompting him to relax, feeling and dynamically balancing the clubhead throughout the swing well enough to hit the ball solidly and squarely at the target.

DESCRIPTION OF THE PRESENT PREFERRED EMBODIMENT

Figure 1:
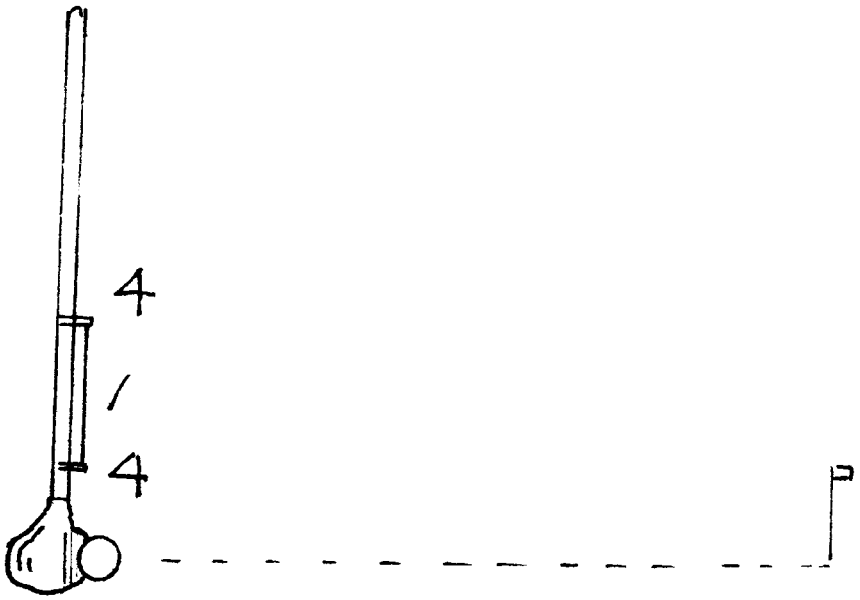
FIG. 1 shows a present preferred embodiment of the tuner with its foil untwisted and elevated parallel to the center of the target side of a 3 wood club and the foil's identical pier-ends snap-fitted to the club-shaft. Only the 0.0015 inch edge of the foil's 7½ inch length is visible between its twin pier-ends.
Figure 2:
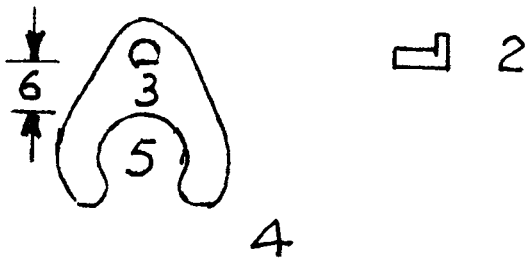
FIG. 2 is a plan view of a pier-end showing both the top flat-bottomed opening in which a plastic plug pins the foil end and the wide opening below which snap-fits and anchors the pier onto the golfer's club-shaft.

Description of the present preferred embodiment.

The 7½ inch long×1/16 inch wide×0.0015 inch thick foil 1 is slit from tensilised plastic film. Matching plastic plugs 2 wedge the opposite ends of the foil into a flat bottomed opening 3 situated on the mid-line of the top of identical and resilient plastic piers 4. The ⅜ inch diameter slotted opening 5 of the pier snap-fits securely onto any shaft section larger than ⅜ inch diameter. A ½ inch gap 6 separates the foil from the shaft.

The golfer presses the twin piers 4 onto the target side of the clubshaft with the foil 1 free of twist between them. He adjusts the piers 4 so the foil 1 is just taut enough to sing at the intended swing speed, centered on the target side of the club-shaft.

The golfer swings the club freely and judges the club's backswing motion and downswing motion by the unit's humming-buzzing club shaft vibrations around him.

Because the foil and clubface swing as one, foil resonance matches the airspeed and plane of clubface motion around the golfer.

At the top of the club's full backswing, the club ought to squarely traverse the golfer's neck humming parallel to the swing line.

Simply by posing in his ideal backswing top position and briskly uncocking -recocking his left wrist squarely, the golfer can attune his left ear to recognise proper backswing top hum-vibration "Go" swing signal 1.

Thenceforth he uses "Go" signal 1 to judge his top-of-the-backswing consistency from swing to swing. Flawed backswing technique results in "No go" backswing top warning signals eg excessively fast hum, off-plane hum, no hum if the clubface is shut at address, hum from takeaway if the clubface is open at address etc.

The golfer gets a "No Go" downswing start warning buzz above head height, when he illadvisedly yanks on the club to start its downswing. The club then wrongly tilts away from the target, buzzing outward above the golfer's head away from the target since his left wrist forcibly uncocks at that instant, instead of ideally just prior to impact.

In contrast, the unit gives "Go" signal 2 as its downswing starts, by remaining silent when the golfer's cocked hands and club free-fall. To get "Go" signal 2, the golfer must transfer his lower body weight toward the target and rotate it just fast enough to keep his feel of the club "even".

Under this impetus, the golfer's fully cocked wrists and clubhead accelerate strongly as the clubhead rounds toward the target about 3 feet from ground level. There the unit emits "Go" signal 3 by buzzing according to the airspeed, attitude and path the clubface develops approaching the bottom point of its swing. For a draw the buzzing path should approach the ball from well inside the ball-target line and more from outside that line to produce a fade.

At impact, buzzing-speed and loudness should peak with the club giving a sweet-spot, square-hit quiver Go Signal 4.

After the hit, the buzzing clubhead flies at the target before losing speed buzzing progressively more softly and slowly around and behind the golfer. "Go" Signal 5.

At the top of the finish side of club travel, the buzzing sound tracks parallel to the swing line, if the shot is straight. "Go" Signal 4. "No Go" warnings correspond to buzzing overhead for sliced shots and too far down the golfer's back for hooks.

To repeat identical swings, the golfer strives to repeat the humming-buzzing "Go" signals of the intended swing, centered and squared to the ball-target line.

While the present preferred embodiment of the invention is shown and described herein, it is to be distinctly understood that the invention is not limited thereto, but may be otherwise variously embodied and practiced within the scope of the following claim both in golf and other uses.

I claim:

1. A golf swing training device comprising, a length of soft, tensilised, cold drawn, polymeric foil, 0.00015 inch thick×1/16 inch wide×about 7–7½ inches long, the opposite ends of said length of foil being secured to a pair of lightweight plastic clips adapted to be placed on the end of a golf club shaft adjacent the club head and tautly suspend said length of foil between said clips and about ¼ inch above the club shaft such that the faces of the resting foil lie flat, tangential and parallel to the target side of the shaft and will produce a humming sound in accordance with the changing air speed and path of the club being swung, thereby enabling the golfer and observer-listeners to melodically correlate club motion to an ideal without unbalancing the club or requiring the tautness of the foil to be reset between swings.

* * * * *